United States Patent [19]

Sone et al.

[11] 4,354,070

[45] Oct. 12, 1982

[54] DISTRIBUTOR FOR INTERNAL COMBUSTION ENGINE

[75] Inventors: Masazumi Sone, Tokyo; Takao Miyashita, Mito; Hiromitsu Nagae, Katsuta, all of Japan

[73] Assignees: Hitachi, Ltd.; Nissan Motor Co., Ltd., both of Tokyo, Japan

[21] Appl. No.: 242,484

[22] Filed: Mar. 11, 1981

[30] Foreign Application Priority Data

Mar. 12, 1980 [JP] Japan ..... 55-30341

[51] Int. Cl.[3] ..... H01H 19/06; H01H 1/00

[52] U.S. Cl. ..... 200/19 R; 200/19 DR; 123/146.5 A

[58] Field of Search ..... 200/19 R, 19 DR, 19 DC, 200/262-270; 123/146.5 A, 633

[56] References Cited

U.S. PATENT DOCUMENTS

| | | | |
|---|---|---|---|
| 3,949,721 | 4/1976 | Hori et al. | 200/19 R X |
| 3,954,094 | 5/1976 | Huebner et al. | 200/19 DR X |
| 4,007,342 | 2/1977 | Makino et al. | 200/19 R |
| 4,039,787 | 8/1977 | Hori et al. | 200/19 R |
| 4,135,066 | 1/1979 | Yamahaka et al. | 200/19 R |
| 4,146,759 | 3/1979 | Watanabe et al. | 200/19 R |
| 4,186,286 | 1/1980 | Kuo et al. | 200/19 DR |

*Primary Examiner*—James R. Scott

*Attorney, Agent, or Firm*—Antonelli, Terry & Wands

[57] ABSTRACT

In a distributor for internal combustion engine, the rotor electrode is formed of a first electrode of a conductive metal, and a second electrode electrically connected to the first electrode. The second electrode is formed of the mixture of fine particles of resistive and conductive materials. The first electrode is made in contact with the center carbon of the distributor, and the second electrode is opposed to the stationary electrode of the distributor. The minimum length from the discharge end surface of the second electrode to the first connection between the first and second electrodes is selected to be 5 mm or above.

5 Claims, 7 Drawing Figures

DISTRIBUTOR FOR INTERNAL COMBUSTION ENGINE

BACKGROUND OF THE INVENTION

This invention relates to distributors for internal combustion engine, and particularly to a distributor for internal combustion engine, capable of suppressing the occurence of noise field from the distributor.

In the interval combustion engine having an electrical ignition system, a noise field of wide frequency band is generally generated to interfere with radio apparatus such as televisions and radios, and therefore it is desired to reduce such noise field to the minimum. One of the noise sources causing such noise field is the discharge between the rotor electrode and the stationary electrode of the distributor of an internal combustion engine.

The methods of suppressing the occurrence of the noise field due to the discharge in the distributor are proposed as follows:

(1) In U.S. Pat. No. 4,007,342, either the rotor electrode or the stationary electrode is provided with a high-value resistor for suppressing the occurrence of noise field; and (2) In U.S. Pat. No. 4,186,286, a dielectric is provided at the tip of the rotor electrode to suppress the occurrence of noise field.

Certainly, the above given methods can suppress the occurrence of noise field to some extent.

However, when more strict suppression of noise field is required in the future, the above methods will not provide satisfactory suppression.

SUMMARY OF THE INVENTION

It is an object of the invention to provide a distributor for internal combustion engine which is capable of suppressing more strictly the occurrence of noise field than the conventional one.

According to the invention, there is provided a distributor for internal combustion engine, comprising a rotor electrode having a first electrode of a conductive metal and a second electrode formed of the mixture of fine particles of resistive and conductive materials and which is connected to the first electrode, a center carbon brush in contact with the first electrode, and a stationary electrode opposed to the second electrode, the minimum length from the discharge end surface of the second electrode to the first connection between the first and second electrodes being selected to be 5 mm or above.

DESCRIPTION OF THE PREFERRED EMBODIMENTS

The present invention will now be described with reference to the accompanying drawings.

Figure 1:
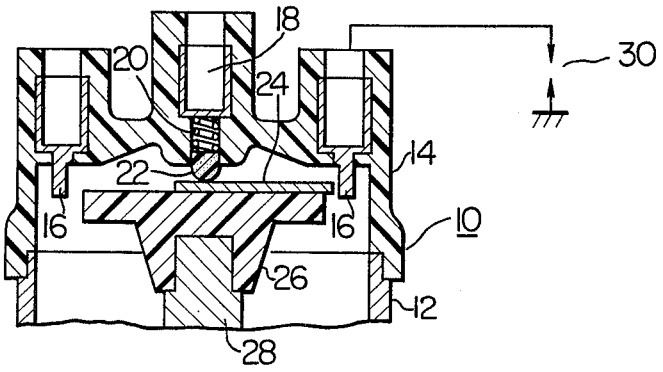
FIG. 1 is a longitudinal section of a main portion of a well known distributor.

FIG. 1 shows the arrangement of a generally known distributor 10. A cap 14 made of an insulating material is mounted on a cylindrical housing 12. This cap 14 has a plurality of stationary electrodes 16 buried in the inner face of its head to be arranged along the same periphery, with one ends of the stationary electrodes 16 projecting from the surface of the cap 14. The projections are covered by the insulating material which is formed continuous to the cap 14. The stationary electrodes 16 are connected to the ignition plugs 30 provided in the plurality of cylinders of an internal combustion engine.

In the center of the inner surface of the cap 14 is buried a central terminal 18, in which a center carbon brush 22 is mounted through a conductive spring 20 to be slidable to the surrounding wall surface of the cap 14.

This center carbon brush 22 is made contact with a plate-like rotor electrode 24 to be pressed thereagainst by the spring 20. The rotor electrode 24 is secured onto the surface of an insulating disc-like base 26 made of a synthetic resin. The discharge-side end of the rotor electrode 24 is opposed to the side of the tip end of the stationary electrode 16 with a small amount of gap spaced therebetween. The insulating base 26 is fixedly mounted on the top of a cam shaft 28 to be driven by the crank shaft of the internal combustion engine.

When the cam shaft 28 is rotated to revolve the rotor electrode 24 to which a high voltage is applied from the central terminal 18, the stationary electrode 16 becomes opposing the rotor electrode 14, at which time electric discharge occurs therebetween to make the rotor electrode 24 and the stationary electrode 16 electrically connected together. This instant, a high voltage is applied to an ignition plug 30 which is connected to the stationary electrode 16.

In this case, a problem is caused that a high-frequency noise field is generated by the discharge between the stationary electrode 16 and the rotor electrode 24.

Means for suppressing the generation of this noise field will be described with reference to FIG. 2. The rotor electrode 24 is composed of a first electrode, here a stainless steel electrode 32 made of stainless steel, and a second electrode, here a ferrite electrode 34 made of ferrite.

The stainless steel electrode 32 and the ferrite electrode 34 are partially overlapped on each other and secured to the insulating base 26. The minimum length "l" from the discharging tip of the ferrite electrode 34 to the first end of the electrical connection between the ferrite electrode 34 and the stainless steel electrode 32 (hereinafter, referred to as the effective ferrite length l) is determined to be 10 mm.

Figure 2:
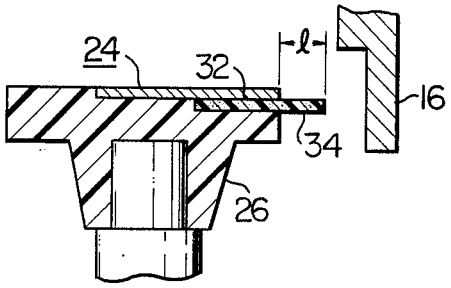
FIG. 2 is a longitudinal section of a main portion of one embodiment of a distributor of the invention.
Figure 3:
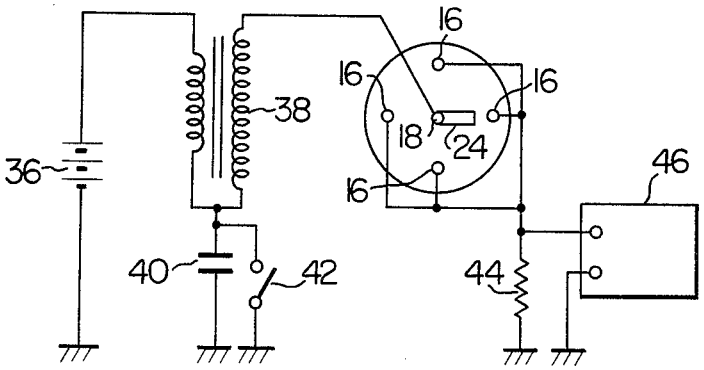
FIG. 3 is a schematical circuit diagram of a noise current meter.

The noise current caused in the distributor of the structure as shown in FIG. 2 was measured on the noise current meter as shown in FIG. 3. In FIG. 3, a battery 36 is connected to the primary of an induction coil 38, another terminal of which is grounded via a capacitor 40 across which primary contacts 42 are connected. The secondary of the induction coil 38 is connected to the central terminal 18 which is connected via the contact to the rotor electrode 24 around which the stationary electrodes 16 are disposed. Each terminal of the stationary electrodes 16 is grounded via a resistor 44 both ends of which are connected to the inputs of a noise meter 46.

When the primary contacts 42 are closed or opened, a high voltage is induced in the secondary of the induction coil 38 and applied to the rotor electrode 24. The rotor electrode 24 is rotated to oppose each stationary electrode, at which time a discharge is caused therebetween. The discharge current is flowed through the resistor 44 to ground, and at the same time noise component caused by the discharge is entered into the noise meter 46.

Figure 4:
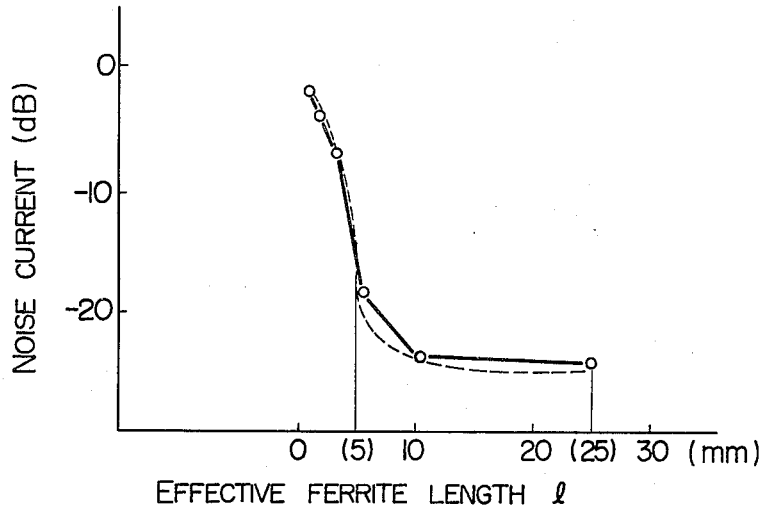
FIG. 4 shows an effective ferrite length vs. noise current curve useful for explaining the effect of the invention.

FIG. 4 shows the results of the noise current with respect to the change of the effective ferrite length l from 1 mm to 25 mm. In FIG. 4, the 0 level of noise current is the value measured when the ferrite powder is attached to the discharge surface of the rotor electrode 24 as shown in FIG. 1, and the lower minus value shows the smaller current.

From FIG. 4, it will be seen that noise current abruptly decreases when the effective ferrite length l is about 5 mm and becomes substantially constant when it is about 10 mm or above. The broken line is an imaginary line showing the degree to which noise current decreases with precise increase of the effective ferrite length l.

Thus, it will be evident that the noise current can be reduced enough by selecting the effective ferrite length l to be 5 mm or above. The reason why the noise current is reduced with increase of the effective ferrite length l is that the ferrite is the mixture of fine particles of resistive and conductive materials and thus after discharge in the ferrite, electric charges are left in the resistive portion and act to facilitate the next occurrence of discharge (which action is hereinafter referred to as the residual electric charge effect) thereby to reduce the initial discharge voltage, leading to decrease of the noise current. The present maximum permissible noise levels can be cleared by suppression of noise field generation through use of a rotor electrode with such a residual electric charge effect. However, it is anticipated that, in the future, the governmental standard for noise will be increased so that use of this rotor electrode with the residual electric charge effect will no longer suffice. Thus, after various discussions of the ferrite length, it was found that selection of 5 mm or above effective ferrite length l can further reduce the noise current. This is because a predetermined resistance value or above of the ferrite with resistance has an action to suppress the oscillating current (this effect will hereinafter be referred to as the filter effect).

Thus, the combination of the residual electric charge effect and the filter effect can be achieved by the ferrite so that it is possible to considerably reduce the noise current. In addition, since the ferrite electrode 34 is not directly made contact with the center carbon 22, but indirectly via the stainless steel electrode 32 thereto, a long life span can be expected from the structure. This is because the direct contact between the stainless steel electrode 32 and the center carbon 22 causes the ferrite electrode 34 to shortly wear so as to lose its practical use.

Other embodiments of the invention will next be described with reference to FIGS. 5 to 7. These embodiments are fundamentally the same as the first embodiment of FIG. 2, but different in the connection between the ferrite electrode 34 and the stainless steel electrode 32 and in the way they are secured to the insulating base 26.

Figure 5:
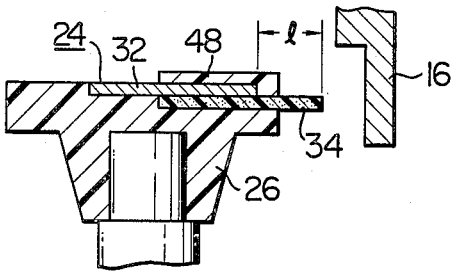
FIGS. 5 to 7 are respectively longitudinal sections of main portions of distributors as other embodiments of the invention.

In the embodiment of FIG. 5, an end of stainless steel electrode 32 on the stationary-electrode 16 side and its surface are covered by an insulating material 48 which is integrally formed with the insulating base 26. Here, the effective ferrite length l is selected to be 10 mm.

Figure 6:
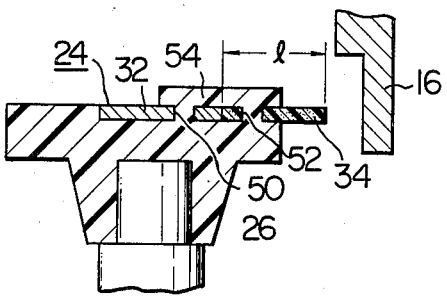

In the embodiment of FIG. 6, the stainless steel electrode 32 with an aperture 50 and the ferrite electrode 34 with an aperture 52 abut against each other in the radial direction to lie on the same plane. Into the apertures 50 and 52 are flowed a resin 54 to integrally form the insulating base 26. The effective ferrite length l is selected to be 15 mm.

Figure 7:
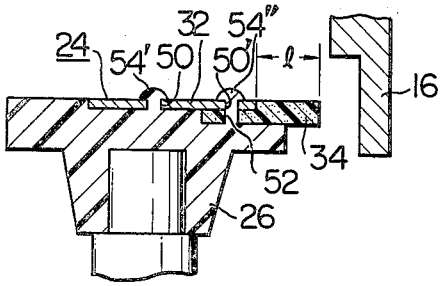

The embodiment of FIG. 7 is a modification of the embodiment of FIG. 6. The stainless steel electrode 32 is provided with apertures 50 and 50', and the aperture 50' is aligned with the aperture 52 of the ferrite electrode 34. Resin materials 54' and 54" are flowed into the apertures 50, 50' and 52 to integrally form the insulating base 26. The effective ferrite length is selected to be 10 mm.

While stainless steel is used for the first electrode as described previously, any of conductive metals such as brass may be used for the electrode.

While ferrite is used for the second electrode as described above, any mixture of fine particles of conductive and resistive materials may be used for the electrode.

We claim:

1. A distributor for internal combustion engine comprising:
   (a) a cam shaft located within a housing to rotate in synchronism with the revolution of an engine;
   (b) a cap detachably engaged with said housing;
   (c) a stationary electrode fastened to said caps the number of which is the same as that of cylinders of the engine;
   (d) a central terminal to which a high voltage is introduced from an ignition coil and which is secured to said cap;
   (e) an insulating base secured to said cam shaft;
   (f) a first electrode of conductive metal secured to said insulating base and which is in contact with a center carbon brush electrically connected to said central terminal; and
   (g) a second electrode electrically connected to said first electrode, secured to said insulating base to oppose said stationary electrode, and which is formed of the mixture of fine particles of conductive and resistive materials, the minimum length from the discharge end of said second electrode to the first contact between said first and second electrodes being selected to be 5 mm or above.

2. A distributor for internal combustion engine according to claim 1, wherein said first electrode is formed of either stainless steel or brass.

3. A distributor for internal combustion engine according to claim 1, wherein said second electrode is formed of ferrite.

4. A distributor for internal combustion engine according to claim 1, wherein a part of said first electrode which is not in contact with said center carbon brush is covered by a synthetic resin which forms said insulating base.

5. A distributor for internal combustion engine according to claim 1, wherein said first and second electrodes are each provided with at least a single aperture, into which is flowed a resin material which also forms said insulating base.

* * * * *